United States Patent [19]

Funada et al.

[11] Patent Number: 4,625,918

[45] Date of Patent: Dec. 2, 1986

[54] FUEL INJECTION VALVE

[75] Inventors: Takeo Funada; Nobuo Kawada; Tatsuhiko Abe, all of Higashimatsuyama, Japan

[73] Assignee: Diesel Kiki Co., Ltd., Japan

[21] Appl. No.: 648,723

[22] Filed: Sep. 7, 1984

[30] Foreign Application Priority Data

Sep. 7, 1983 [JP] Japan ..... 58-137892[U]

[51] Int. Cl.[4] ..... F02M 61/10

[52] U.S. Cl. ..... 239/533.3; 123/494

[58] Field of Search ..... 239/533.2–533.12, 239/584, 585; 123/494; 73/119 A

[56] References Cited

U.S. PATENT DOCUMENTS 4,111,178 9/1978 Casey ..... 123/643

4,340,181 7/1982 Stumpp et al. ..... 239/533.3

4,398,670 8/1983 Hofmann ..... 239/533.11

*Primary Examiner*—Joseph F. Peters, Jr.

*Assistant Examiner*—Michael J. Forman

*Attorney, Agent, or Firm*—Guy W. Shoup

[57] ABSTRACT

In a fuel injection valve, a nozzle body having a valve seat, and mounted through an electrically conductive spacer on a nozzle holder, a needle valve and an insulating layer constitute an ON-OFF switch for producing signals indicating the beginning and completion of injection, and an electrical insulation member provided between the rear end surface of the needle valve and the spacer to maintain the insulated state between the needle valve and the nozzle body during the fuel injection operation.

11 Claims, 3 Drawing Figures

FUEL INJECTION VALVE

BACKGROUND OF THE INVENTION

The present invention relates to a fuel injection valve for internal combustion engines, and more particularly to a fuel injection valve in which an ON-OFF switch is constituted by a needle valve and a nozzle body.

In prior art, for the purpose of obtaining electric signals indicating the beginning and completion of fuel injection in accordance with the movement of a needle valve, there have been disclosed various fuel injection valves in which an ON-OFF switch is constituted by a nozzle body of conductive material and a needle valve of conductive material which is capable of smoothly moving in a guide hole defined in the nozzle body (as disclosed, for example, in U.S. Pat. Nos. 4,111,178 and 4,398,670).

In the conventional fuel injection valves disclosed above, an appropriate insulating layer is provided between the needle valve and the guide surface of the guide hole of the nozzle body so that electrical contact occurs between the needle valve and the nozzle body only when the needle valve is seated on the valve seat formed in the nozzle body and a state of complete electrical discontinuity occurs between the needle valve and the nozzle body when the needle valve is lifted upon the application of pressurized fuel.

However, in the conventional fuel injection valve constructed as described above, since there is a probability that the rear end surface of the needle valve temporarily comes into contact with the spacer in the nozzle holder when the needle valve is lifted up to its allowable stroke at the time of the fuel injecting operation, there may occur the disadvantage that noise signals in the form of narrow pulses are superposed on the desired signal obtained from the ON-OFF switch of the fuel injection valve. That is, in the conventional fuel injection valve with an ON-OFF switch, even if the fuel injection valve is in the state of fuel injection, a state similar to the closed condition of the ON-OFF switch occurs momentarily. As a result, in the prior art, it is impossible to obtain a signal indicative of the lift condition of the needle valve, the level of which is maintained at a predetermined level during the fuel injecting operation. Consequently, since it is not possible to easily detect the duration of the open condition of the fuel injection valve on the basis of the signal obtained from the ON-OFF switch, an additional circuit such as a signal discriminating circuit is required.

SUMMARY OF THE INVENTION

It is an object of the present invention to provide an improved fuel injection valve with an ON-OFF switch for producing a signal showing whether or not the needle valve is in the lifted state.

It is another object of the present invention to provide a fuel injection valve with an ON-OFF switch in which it is possible to produce a signal whose level is maintained at a predetermined level at the open condition of the fuel injection valve.

According to the present invention, in a fuel injection valve comprising a nozzle body made of a conductive material and having a valve seat, the nozzle body being mounted through a conductive spacer on a nozzle holder, and a needle valve made of a conductive material and slidably supported and guided by a guide hole defined in the nozzle body, an ON-OFF switch is formed by the valve seat, the needle valve and an insulating layer formed on the peripheral surface thereof, whereby an electrically conductive state is established between the needle valve and the nozzle body when the needle valve is seated on the valve seat and an electrically insulated state is established between the needle valve and the nozzle body when the needle valve is lifted from the valve seat upon the application of pressurized fuel, and an electric insulation member is provided between the rear end surface of the needle valve and the spacer.

As the electric insulation member to be provided between the rear end surface of the needle valve and the spacer, a thin film bush made of a polyethylene terephthalate may be used. Moreover, the insulation member can be formed by coating an insulating film (such as $SiO_2$ film) on the rear end of the needle valve or the surface of the spacer opposite to the rear end surface of the needle valve by the use of such methods as dipping, sputtering, ion-plating and the like.

With this structure, even when the needle valve is lifted to its allowable stroke, the rear end surface of the needle valve does not come into electrical contact with the spacer during the fuel injecting operation, so that the ON-OFF switch formed by the needle valve and the nozzle body may be maintained in its open state between the time of the beginning of fuel injection and the termination of fuel injection. As a result, it is possible to easily obtain a signal directly indicating the time of the opening of the fuel injection valve without an additional circuit such as a signal discriminating circuit, so that a signal processing circuit connected to the ON-OFF switch may be simple in construction.

That is, it is possible to obtain a high quality signal indicative of the opened/closed state of the fuel injection valve, in which the level is reliably changed in accordance with the opening and the closing of the fuel injection valve without the production of undesired noise signals.

The invention will be better understood and the other objects and advantages thereof will be more apparent from the following detailed description of a preferred embodiment made with reference to the accompanying drawings.

DESCRIPTION OF THE PREFERRED EMBODIMENT

Figure 1:
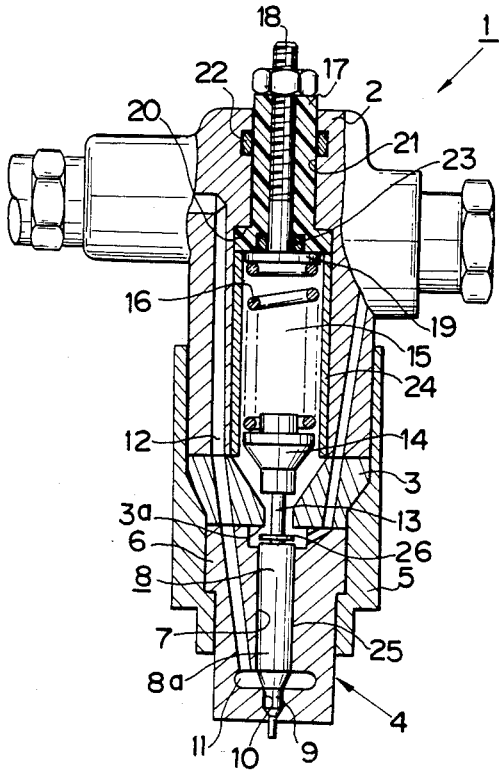
FIG. 1 is a sectional view of an embodiment of a fuel injection valve according to the present invention.

Referring to FIG. 1, a fuel injection valve 1 has a nozzle holder 2, a spacer 3 and a nozzle 4, which are threaded into a sleeve nut 5. The nozzle 4 is composed of a nozzle body 6 and a needle valve 8 received in a guide hole 7 so as to be smoothly slidable therein. A conical member 9 which serves as a valve body is formed at the end portion of the needle valve 8 and a valve seat 10 the shape of which matches the conical member 9 is defined in the nozzle body 6. A chamber 11 is defined in the nozzle body 6 adjacent to the valve seat 10 and the chamber 11 is communicated with a fuel path 12.

The needle valve 8 is made of steel and is electrically connected to a conductive spring seat 14 through a conductive pin 13 when the fuel injection valve 1 is in a closed condition.

A coil spring 16 is received in a spring chamber 15 defined in the nozzle holder 2, and one end portion of the coil spring 16 is supported by a shoulder portion 20 formed in the spring chamber 15 via a disc portion 19 formed at the lower end of an electrode 18 inserted into an insulation sleeve 17 in a force-fit condition while the other end of the coil spring 16 is supported by the spring seat 14. The insulation sleeve 17 is provided for insulating the conductive nozzle holder 2 from the electrode 18 and may be inserted into a hole 21 of the nozzle holder 2 snugly or with some clearance. Reference numerals 22 and 23 denote O-rings for maintaining an oil-tight condition.

The coil spring 16 is also made from suitable electrically conductive materials such as steel, so that the electrode 18 and the needle valve 8 are in an electrically connected condition through the pin 13, the spring seat 14 and the coil spring 16. To prevent the coil spring 16 from coming into electrical connection with the nozzle holder 2, there is provided an insulation sleeve 24, which is especially necessary in a small fuel injection valve because of the small distance between the coil spring 16 and the wall surface of the spring chamber 15. The nozzle body 6, the spacer 3, the sleeve nut 5 and the nozzle holder 2 are also made from electrically conductive materials.

Figure 2:
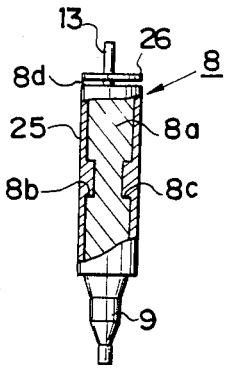
FIG. 2 is an enlarged perspective view, partly in section, of the needle valve shown in FIG. 1.

An insulating layer 25 made of highly durable insulating resin is integrally formed on the outer surface of the needle valve 8 as shown in FIG. 2, so as to insulate the outer surface of the large diameter portion $8_a$ of the needle valve 8 from the guide surface $7_a$ of the guide hole 7. Concaves $8_b$ and $8_c$ are defined at the middle portion of the large diameter portion $8_a$ of the needle valve 8. Consequently, when the insulating layer 25 is integrally formed on the needle valve 8, it is not only formed on the outer surface of the needle valve 8 but also enters into the concaves $8_b$ and $8_c$. As a result, the insulating layer 25 is physically integrated with the needle valve 8 in such a way that it cannot move around the needle valve 8. As the insulating resin of the insulating layer 25 there can be used, for example, a resin having high durability such as polyphenylene sulfide (PPS).

When the insulating layer 25 is made of an insulating resin such as polyphenylene sulfide, it suffers little wear and provides sufficient smoothness in motion between the needle valve 8 and the nozzle body 6.

The insulating layer 25 can be formed as an insulation film coated on the peripheral surface of the needle valve 8 by the method of dipping, sputtering, ion-plating or the like. In this case, the formation of the concaves $8_b$ and $8_c$ is not necessary.

To prevent the rear end surface $8_d$ of the needle valve 8 from coming into electrically contact with the spacer 3, an insulating sheet 26 which is formed as a thin film is provided between the rear end surface $8_d$ of the needle valve 8 and the spacer 3.

Figure 3:
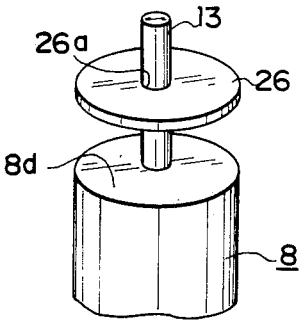
FIG. 3 is a perspective view showing an assembled state of the insulating sheet.

As shown in FIG. 3, the insulating sheet 26 is a circular sheet member with a hole $26_a$ at the center thereof, in order to be able to insert the pin 13 into the insulating sheet 26 therethrough. The insulating sheet 26 may, for example, be made of polyethylene terephthalate. The insulation sheet 26 of approximately 0.1 mm in thickness is sufficient for ordinary use and reliably prevents for a long time occurrence of electrical contact between the needle valve 8 and the spacer 3 during the fuel injecting operation when the insulation sheet 26 is provided between the rear end surface $8_d$ of the needle valve 8 and the spacer 3.

In place of the insulation sheet 26, an insulation film in the form of a thin film may be coated on the rear end surface $8_d$ of the needle valve 8 or on the surface $3_a$ of the spacer opposite to the rear end surface $8_d$ by the use of a physical deposition method such as dipping, sputtering or ion-plating.

To obtain an electric signal indicating the time at which the fuel injection begins when the fuel injection valve 1 as shown in FIG. 1 is used, the nozzle body 6 is grounded and the electrode 18 is connected to the voltage source +V through a resistor 27. With this circuit arrangement, a voltage Vo is developed across the resistor 27 only when the needle valve 8 is seated on the valve seat 10. That is, since the needle valve 8 and the nozzle body 6 constitute an ON-OFF switch which is closed when the fuel injection valve 1 is closed, the current from the voltage source +V flows through the resistor 27 and a voltage drop of a predetermined value develops across the resistor 27. On the other hand, the electrical connection between the needle valve 8 and the nozzle body 6 is broken when the fuel injection operation starts by the introduction of the pressurized fuel into the chamber 11, and the current flow through the resistor 27 becomes zero so that the voltage developed across the resistor 27 becomes zero.

With this structure, to form a signal generator for obtaining a signal indicative of the opened/closed state of the fuel injection valve in response to the lifting motion of the needle valve 8, when the nozzle body 6 is grounded and the electrode 18 is connected to the voltage source +V through a resistor 27, the rear end surface $8_d$ of the needle valve 8 does not come into electrical contact with the spacer 3 during the fuel injecting operation, so that the ON-OFF switch formed by the needle valve 8 and the nozzle body 6 may be maintained in its open state between the time of the beginning of fuel injection and the termination of fuel injection. As a result, it is possible to easily obtain a signal directly indicating the time of the opening of the fuel injection valve without an additional circuit such as a signal discriminating circuit, so that a signal processing circuit connected to the ON-OFF switch may be simple in construction.

We claim:

1. In a fuel injection valve of the type having an ON-OFF switch formed by a nozzle body made of a conductive material and having a valve seat, said nozzle body being mounted through a conductive spacer on a nozzle holder, a needle valve made of a conductive material and slidably supported and guided by a guide hole defined in said nozzle body, said needle valve having a needle end, a rear end, a member extending between said ends having a peripheral surface, and an insulating layer on said peripheral surface so as to insulate said needle valve from said nozzle body, means including a pin mounting said needle valve on an end thereof for moving said needle valve supported in said guide hole so as to lift said needle end thereof onto and away from said valve seat, and electrical means for applying a potential between said nozzle body and said needle valve, whereby an electrically conductive state is established between said needle valve and said nozzle body when said needle end is seated on said valve seat and an electrically insulated state is established between said needle valve and said nozzle body when said needle end is moved away from said valve seat, the improvement comprising an electrical insulation member between said rear end of said needle valve and a surface of said conductive spacer facing said rear end so as to insulate said needle valve from said conductive spacer, said surface of said conductive spacer defining an outer limit of movement of said needle valve when said needle valve is moved away from said valve seat.

2. A fuel injection valve as claimed in claim 1, wherein said insulation member is an insulation sheet in the form of a thin film.

3. A fuel injection valve as claimed in claim 2, wherein said insulation sheet is made of polyethylene terephthalate.

4. A fuel injection valve as claimed in claim 1, wherein said insulating layer is formed on the surface of said needle valve opposed to the guide hole so as to establish an electrically insulated state between the needle valve and the guide surface of the guide hole.

5. A fuel injection valve as claimed in claim 4, wherein said insulating layer is made of a highly durable insulating resin.

6. A fuel injection valve as claimed in claim 5, wherein at least one concave portion for receiving a part of the insulating layer when the insulating layer is formed is provided on the peripheral surface of the needle valve, whereby the insulating layer is prevented from moving on the peripheral surface of the needle valve.

7. A fuel injection valve as claimed in claim 4, wherein said insulating layer is formed as an insulating film coated on the peripheral surface of the needle valve by the use of a physical deposition method.

8. A fuel injection valve as claimed in claim 1, wherein said insulation member is an insulating film coated on the surface of the spacer opposite to the rear end surface of the needle valve.

9. A fuel injection valve as claimed in claims 8, wherein the insulating film is formed by the use of a physical deposition method.

10. A fuel injection valve as claimed in claim 1, wherein said insulation member is an insulating film coated on the rear end surface of the needle valve.

11. A fuel injection valve according to claim 10, wherein the insulating film is formed by the use of a physical deposition method.

* * * * *